US009384755B2

(12) United States Patent
Vaillancourt et al.

(10) Patent No.: US 9,384,755 B2
(45) Date of Patent: Jul. 5, 2016

(54) DEVICE AND METHOD FOR REDUCING QUANTIZATION NOISE IN A TIME-DOMAIN DECODER

(71) Applicant: VOICEAGE CORPORATION, Town of Mount Royal (CA)

(72) Inventors: Tommy Vaillancourt, Sherbrooke (CA); Milan Jelinek, Sherbrooke (CA)

(73) Assignee: VOICEAGE CORPORATION, Town of Mount Royal (CA)

( * ) Notice: Subject to any disclaimer, the term of this patent is extended or adjusted under 35 U.S.C. 154(b) by 101 days.

(21) Appl. No.: 14/196,585

(22) Filed: Mar. 4, 2014

(65) Prior Publication Data

US 2014/0249807 A1 Sep. 4, 2014

Related U.S. Application Data

(60) Provisional application No. 61/772,037, filed on Mar. 4, 2013.

(51) Int. Cl.
*G10L 21/0208* (2013.01)
*G10L 19/26* (2013.01)
(Continued)

(52) U.S. Cl.
CPC ..... *G10L 21/0208* (2013.01); *G10L 19/26* (2013.01); *G10L 25/21* (2013.01); *G10L 25/78* (2013.01); *G10L 25/93* (2013.01)

(58) Field of Classification Search
CPC ..... G10L 19/03; G10L 21/0208
See application file for complete search history.

(56) References Cited

U.S. PATENT DOCUMENTS 5,659,661 A 8/1997 Ozawa
2006/0271354 A1 11/2006 Sun et al.
(Continued)

FOREIGN PATENT DOCUMENTS

WO 03/102921 12/2003
WO 2007/073604 7/2007
(Continued)

OTHER PUBLICATIONS

Johnston, "Transform Coding of Audio Signals Using Perceptual Noise Criteria," IEEE Journal on Selected Areas in Communications, vol. 6, No. 2, Feb. 1988, pp. 314-323.
(Continued)

*Primary Examiner* — Douglas Godbold
(74) *Attorney, Agent, or Firm* — Fay Kaplun & Marcin, LLP

(57) ABSTRACT

The present disclosure relates to a device and method for reducing quantization noise in a signal contained in a time-domain excitation decoded by a time-domain decoder. The decoded time-domain excitation is converted into a frequency-domain excitation. A weighting mask is produced for retrieving spectral information lost in the quantization noise. The frequency-domain excitation is modified to increase spectral dynamics by application of the weighting mask. The modified frequency-domain excitation is converted into a modified time-domain excitation. The method and device can be used for improving music content rendering of linear-prediction (LP) based codecs. Optionally, a synthesis of the decoded time-domain excitation may be classified into one of a first set of excitation categories and a second set of excitation categories, the second set including INACTIVE or UNVOICED categories, the first set including an OTHER category.

30 Claims, 4 Drawing Sheets

(51) Int. Cl.

| | |
|---|---|
| *G10L 25/78* | (2013.01) |
| *G10L 25/93* | (2013.01) |
| *G10L 25/21* | (2013.01) |

(56) References Cited

U.S. PATENT DOCUMENTS

| | | | | |
|---|---|---|---|---|
| 2010/0183067 | A1* | 7/2010 | Garcia et al. | 375/240 |
| 2011/0002225 | A1* | 1/2011 | Nomura et al. | 370/241 |
| 2011/0002266 | A1 | 1/2011 | Gao | |
| 2011/0046947 | A1* | 2/2011 | Vaillancourt et al. | 704/226 |
| 2011/0145003 | A1* | 6/2011 | Bessette | 704/500 |
| 2011/0270616 | A1* | 11/2011 | Garudadri et al. | 704/500 |
| 2012/0253797 | A1* | 10/2012 | Geiger et al. | 704/219 |
| 2012/0271644 | A1* | 10/2012 | Bessette et al. | 704/500 |
| 2013/0110507 | A1* | 5/2013 | Gao | 704/219 |
| 2013/0218557 | A1* | 8/2013 | Gao | 704/226 |

FOREIGN PATENT DOCUMENTS

| | | |
|---|---|---|
| WO | 2009/109050 | 9/2009 |
| WO | 2013/063688 | 5/2013 |

OTHER PUBLICATIONS

3GPP (TS) 26.190 of the 3rd Generation Partnership Program (3GPP), "Adaptive Multi-Rate-Wideband (AMR-WB) speech codec; Transcoding Functions", Sep. 2012, 51 pps.

* cited by examiner

DEVICE AND METHOD FOR REDUCING QUANTIZATION NOISE IN A TIME-DOMAIN DECODER

TECHNICAL FIELD

The present disclosure relates to the field of sound processing. More specifically, the present disclosure relates to reducing quantization noise in a sound signal.

BACKGROUND

State-of-the-art conversational codecs represent with a very good quality clean speech signals at bitrates of around 8 kbps and approach transparency at the bitrate of 16 kbps. To sustain this high speech quality at low bitrate a multi-modal coding scheme is generally used. Usually the input signal is split among different categories reflecting its characteristic. The different categories include e.g. voiced speech, unvoiced speech, voiced onsets, etc. The codec then uses different coding modes optimized for these categories.

Speech-model based codecs usually do not render well generic audio signals such as music. Consequently, some deployed speech codecs do not represent music with good quality, especially at low bitrates. When a codec is deployed, it is difficult to modify the encoder due to the fact that the bitstream is standardized and any modifications to the bitstream would break the interoperability of the codec.

Therefore, there is a need for improving music content rendering of speech-model based codecs, for example linear-prediction (LP) based codecs.

BRIEF DESCRIPTION OF THE DRAWINGS

Embodiments of the disclosure will be described by way of example only with reference to the accompanying drawings, in which.

DETAILED DESCRIPTION

Figure 1:
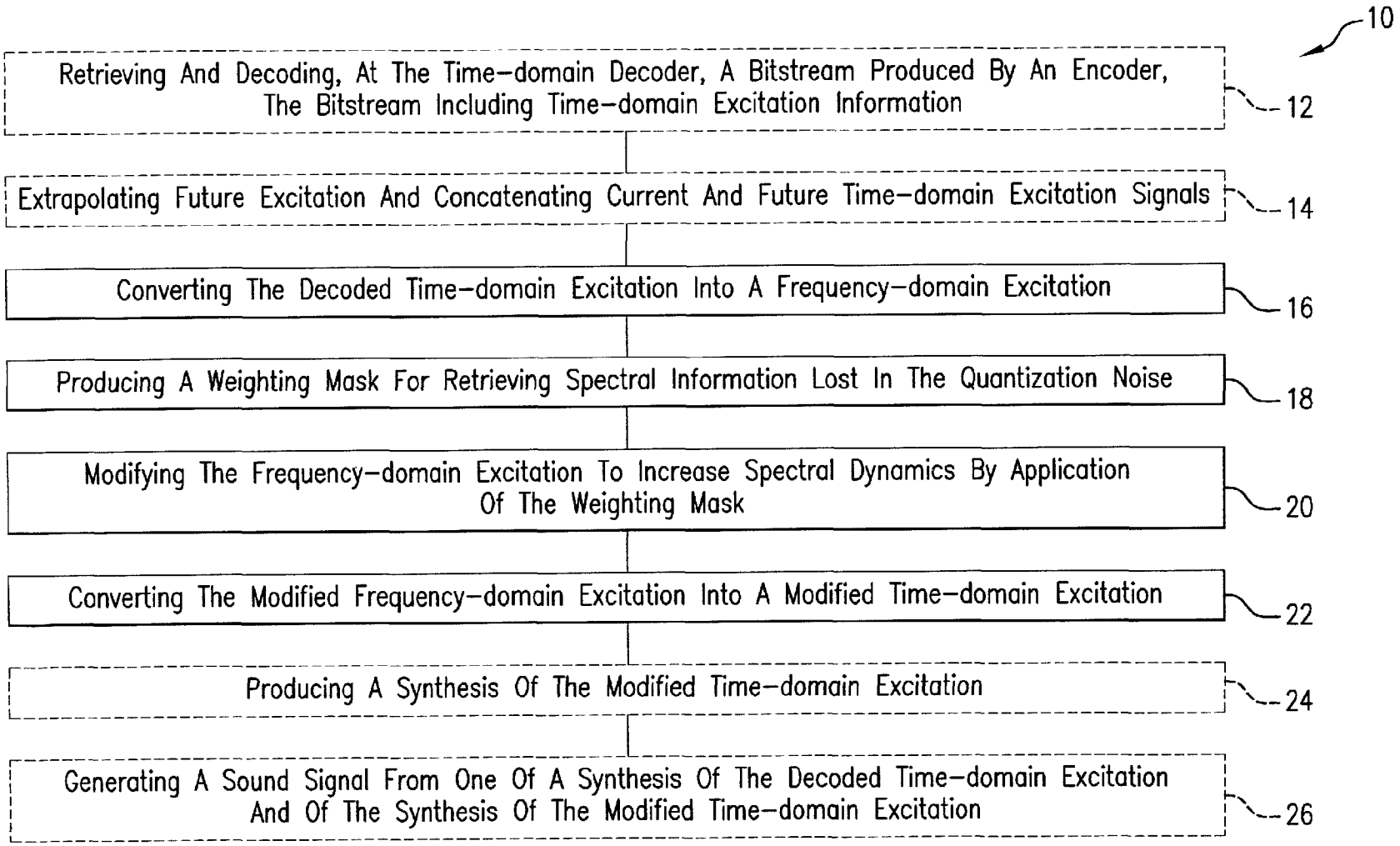
FIG. 1 is a flow chart showing operations of a method for reducing quantization noise in a signal contained in a time-domain excitation decoded by a time-domain decoder according to an embodiment.

According to a first aspect, the present disclosure is concerned with a device for reducing quantization noise in a signal contained in a time-domain excitation decoded by a time-domain decoder. The device comprises a converter of the decoded time-domain excitation into a frequency-domain excitation. Also included is a mask builder to produce a weighting mask for retrieving spectral information lost in the quantization noise. The device also comprises a modifier of the frequency-domain excitation to increase spectral dynamics by application of the weighting mask. The device further comprises a converter of the modified frequency-domain excitation into a modified time-domain excitation.

According to another aspect, the present disclosure relates to a method for reducing quantization noise in a signal contained in a time-domain excitation decoded by a time-domain decoder. The decoded time-domain excitation is converted into a frequency-domain excitation by the time-domain decoder. A weighting mask is produced for retrieving spectral information lost in the quantization noise. The frequency-domain excitation is modified to increase spectral dynamics by application of the weighting mask. The modified frequency-domain excitation is converted into a modified time-domain excitation.

The foregoing and other features of the device and method for reducing quantization noise in a signal contained in a time-domain excitation decoded by a time-domain decoder will become more apparent upon reading of the following non-restrictive description, given by way of non limitative example with reference to the accompanying drawings.

Various aspects of the present disclosure generally address one or more of the problems of improving music content rendering of speech-model based codecs, for example linear-prediction (LP) based codecs, by reducing quantization noise in a music signal. It should be kept in mind that the teachings of the present disclosure may also apply to other sound signals, for example generic audio signals other than music.

Modifications to the decoder can improve the perceived quality on the receiver side. The present discloses an approach to implement, on the decoder side, a frequency domain post processing for music signals and other sound signals that reduces the quantization noise in the spectrum of the decoded synthesis. The post processing can be implemented without any additional coding delay.

The principle of frequency domain removal of the quantization noise between spectrum harmonics and the frequency post processing used herein are based on PCT Patent publication WO 2009/109050 A1 to Vaillancourt et al., dated Sep. 11, 2009 (hereinafter "Vaillancourt '050"), the disclosure of which is incorporated by reference herein. In general, such frequency post-processing is applied on the decoded synthesis and requires an increase of the processing delay in order to include an overlap and add process to get a significant quality gain. Moreover, with the traditional frequency domain post processing, shorter is the delay added (i.e. shorter is the transform window), less the post processing is effective due to limited frequency resolution. According to the present disclosure, the frequency post processing achieves higher frequency resolution (a longer frequency transform is used), without adding delay to the synthesis. Furthermore, the information present in the past frames spectrum energy is exploited to create a weighting mask that is applied to the current frame spectrum to retrieve, i.e. enhance, spectral information lost into the coding noise. To achieve this post processing without adding delay to the synthesis, in this example, a symmetric trapezoidal window is used. It is centered on the current frame where the window is flat (it has a constant value of 1), and extrapolation is used to create the future signal. While the post processing might be generally applied directly to the synthesis signal of any codec, the present disclosure introduces an illustrative embodiment in which the post processing is applied to the excitation signal in a framework of the Code-Excited Linear Prediction (CELP) codec, described Technical Specification (TS) 26.190 of the 3$^{rd}$ Generation Partnership Program (3GPP), entitled "Adaptive Multi-Rate—Wideband (AMR-WB) speech codec; Transcoding Functions", available on the web site of the 3GPP, of which the full content is herein incorporated by reference. The advantage of working on the excitation signal rather than on the synthesis signal is that any potential discontinuities introduced by the post processing are smoothed out by the subsequent application of the CELP synthesis filter.

In the present disclosure, AMR-WB with an inner sampling frequency of 12.8 kHz is used for illustration purposes.

However, the present disclosure can be applied to other low bitrate speech decoders where the synthesis is obtained by an excitation signal filtered through a synthesis filter, for example a LP synthesis filter. It can be applied as well on multi-modal codecs where the music is coded with a combination of time and frequency domain excitation. The next lines summarize the operation of a post filter. A detailed description of an illustrative embodiment using AMR-WB then follows.

First, the complete bitstream is decoded and the current frame synthesis is processed through a first-stage classifier similar to what is disclosed in PCT Patent publication WO 2003/102921 A1 to Jelinek et al., dated Dec. 11, 2003, in PCT Patent publication WO 2007/073604 A1 to Vaillancourt et al., dated Jul. 5, 2007 and in PCT International Application PCT/CA2012/001011 filed on Nov. 1, 2012 in the names of Vaillancourt et al. (hereinafter "Vaillancourt '011"), the disclosures of which are incorporated by reference herein. For the purpose of the present disclosure, this first-stage classifier analyses the frame and sets apart INACTIVE frames and UNVOICED frames, for example frames corresponding to active UNVOICED speech. All frames that are not categorized as INACTIVE frames or as UNVOICED frames in the first-stage are analyzed with a second-stage classifier. The second-stage classifier decides whether to apply the post processing and to what extent. When the post processing is not applied, only the post processing related memories are updated.

For all frames that are not categorized as INACTIVE frames or as active UNVOICED speech frames by the first-stage classifier, a vector is formed using the past decoded excitation, the current frame decoded excitation and an extrapolation of the future excitation. The length of the past decoded excitation and the extrapolated excitation is the same and depends of the desired resolution of the frequency transform. In this example, the length of the frequency transform used is 640 samples. Creating a vector with the past and the extrapolated excitation allows for increasing the frequency resolution. In the present example, the length of the past and the extrapolated excitation is the same, but window symmetry is not necessarily required for the post-filter to work efficiently.

The energy stability of the frequency representation of the concatenated excitation (including the past decoded excitation, the current frame decoded excitation and the extrapolation of the future excitation) is then analyzed with the second-stage classifier to determine the probability of being in presence of music. In this example, the determination of being in presence of music is performed in a two-stage process. However, music detection can be performed in different ways, for example it might be performed in a single operation prior the frequency transform, or even determined in the encoder and transmitted in the bitstream.

The inter-harmonic quantization noise is reduced similarly as in Vaillancourt '050 by estimating the signal to noise ratio (SNR) per frequency bin and by applying a gain on each frequency bin depending on its SNR. In the present disclosure, the noise energy estimation is however done differently from what is taught in Vaillancourt '050.

Then an additional processing is used that retrieves the information lost in the coding noise and further increases the dynamics of the spectrum. This process begins with the normalization between 0 and 1 of the energy spectrum. Then a constant offset is added to the normalized energy spectrum. Finally, a power of 8 is applied to each frequency bin of the modified energy spectrum. The resulting scaled energy spectrum is processed through an averaging function along the frequency axis, from low frequencies to high frequencies. Finally, a long term smoothing of the spectrum over time is performed bin by bin.

This second part of the processing results in a mask where the peaks correspond to important spectrum information and the valleys correspond to coding noise. This mask is then used to filter out noise and increase the spectral dynamics by slightly increasing the spectrum bins amplitude at the peak regions while attenuating the bins amplitude in the valleys, therefore increasing the peak to valley ratio. These two operations are done using a high frequency resolution, but without adding delay to the output synthesis.

After the frequency representation of the concatenated excitation vector is enhanced (its noise reduced and its spectral dynamics increased), the inverse frequency transform is performed to create an enhanced version of the concatenated excitation. In the present disclosure, the part of the transform window corresponding to the current frame is substantially flat, and only the parts of the window applied to the past and extrapolated excitation signal need to be tapered. This renders possible to extirpate the current frame of the enhanced excitation after the inverse transform. This last manipulation is similar to multiplying the time-domain enhanced excitation with a rectangular window at the position of the current frame. While this operation could not be done in the synthesis domain without adding important block artifacts, this can alternatively be done in the excitation domain, because the LP synthesis filter helps smoothing the transition from one block to another as shown in Vaillancourt '011.

Description of the Illustrative AMR-WB Embodiment

The post processing described here is applied on the decoded excitation of the LP synthesis filter for signals like music or reverberant speech. A decision about the nature of the signal (speech, music, reverberant speech, and the like) and a decision about applying the post processing can be signaled by the encoder that sends towards a decoder classification information as a part of an AMR-WB bitstream. If this is not the case, a signal classification can alternatively be done on the decoder side. Depending on the complexity and the classification reliability trade-off, the synthesis filter can optionally be applied on the current excitation to get a temporary synthesis and a better classification analysis. In this configuration, the synthesis is overwritten if the classification results in a category where the post filtering is applied. To minimize the added complexity, the classification can also be done on the past frame synthesis, and the synthesis filter would be applied once, after the post processing.

Referring now to the drawings, FIG. 1 is a flow chart showing operations of a method for reducing quantization noise in a signal contained in a time-domain excitation decoded by a time-domain decoder according to an embodiment. In FIG. 1, a sequence 10 comprises a plurality of operations that may be executed in variable order, some of the operations possibly being executed concurrently, some of the operations being optional. At operation 12, the time-domain decoder retrieves and decodes a bitstream produced by an encoder, the bitstream including time domain excitation information in the form of parameters usable to reconstruct the time domain excitation. For this, the time-domain decoder may receive the bitstream via an input interface or read the bitstream from a memory. The time-domain decoder converts the decoded time-domain excitation into a frequency-domain excitation at operation 16. Before converting the excitation signal from time-domain to frequency domain at operation 16, the future time domain excitation may be extrapolated, at operation 14, so that a conversion of the time-domain excitation into a frequency-domain excitation becomes delay-less. That is, better frequency analysis is performed without the need for extra delay. To this end past, current and predicted future time-domain excitation signal may be concatenated before conversion to frequency domain. The time-domain decoder then produces a weighting mask for retrieving spectral information lost in the quantization noise, at operation 18. At operation 20, the time-domain decoder modifies the frequency-domain excitation to increase spectral dynamics by application of the weighting mask. At operation 22, the time-domain decoder converts the modified frequency-domain excitation into a modified time-domain excitation. The time-domain decoder can then produce a synthesis of the modified time-domain excitation at operation 24 and generate a sound signal from one of a synthesis of the decoded time-domain excitation and of the synthesis of the modified time-domain excitation at operation 26.

The method illustrated in FIG. 1 may be adapted using several optional features. For example, the synthesis of the decoded time-domain excitation may be classified into one of a first set of excitation categories and a second set of excitation categories, in which the second set of excitation categories comprises INACTIVE or UNVOICED categories while the first set of excitation categories comprises an OTHER category. A conversion of the decoded time-domain excitation into a frequency-domain excitation may be applied to the decoded time-domain excitation classified in the first set of excitation categories. The retrieved bitstream may comprise classification information usable to classify the synthesis of the decoded time-domain excitation into either of the first set or second sets of excitation categories. For generating the sound signal, an output synthesis can be selected as the synthesis of the decoded time-domain excitation when the time-domain excitation is classified in the second set of excitation categories, or as the synthesis of the modified time-domain excitation when the time-domain excitation is classified in the first set of excitation categories. The frequency-domain excitation may be analyzed to determine whether the frequency-domain excitation contains music. In particular, determining that the frequency-domain excitation contains music may rely on comparing a statistical deviation of spectral energy differences of the frequency-domain excitation with a threshold. The weighting mask may be produced using time averaging or frequency averaging or a combination of both. A signal to noise ratio may be estimated for a selected band of the decoded time-domain excitation and a frequency-domain noise reduction may be performed based on the estimated signal to noise ratio.

Figure 2A:
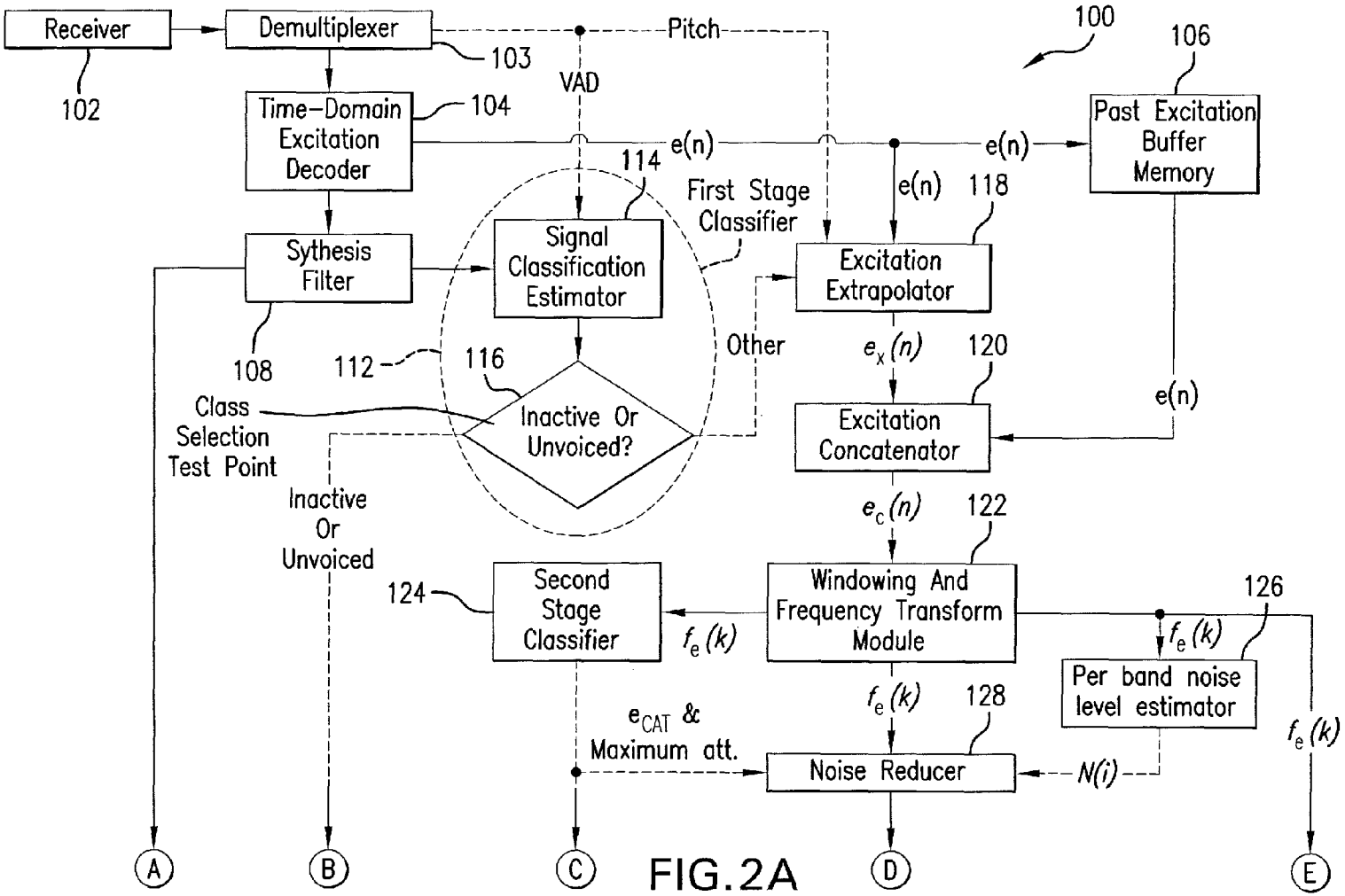
FIGS. 2*a* and 2*b*, collectively referred to as FIG. 2, are a simplified schematic diagram of a decoder having frequency domain post processing capabilities for reducing quantization noise in music signals and other sound signals.
Figure 2B:
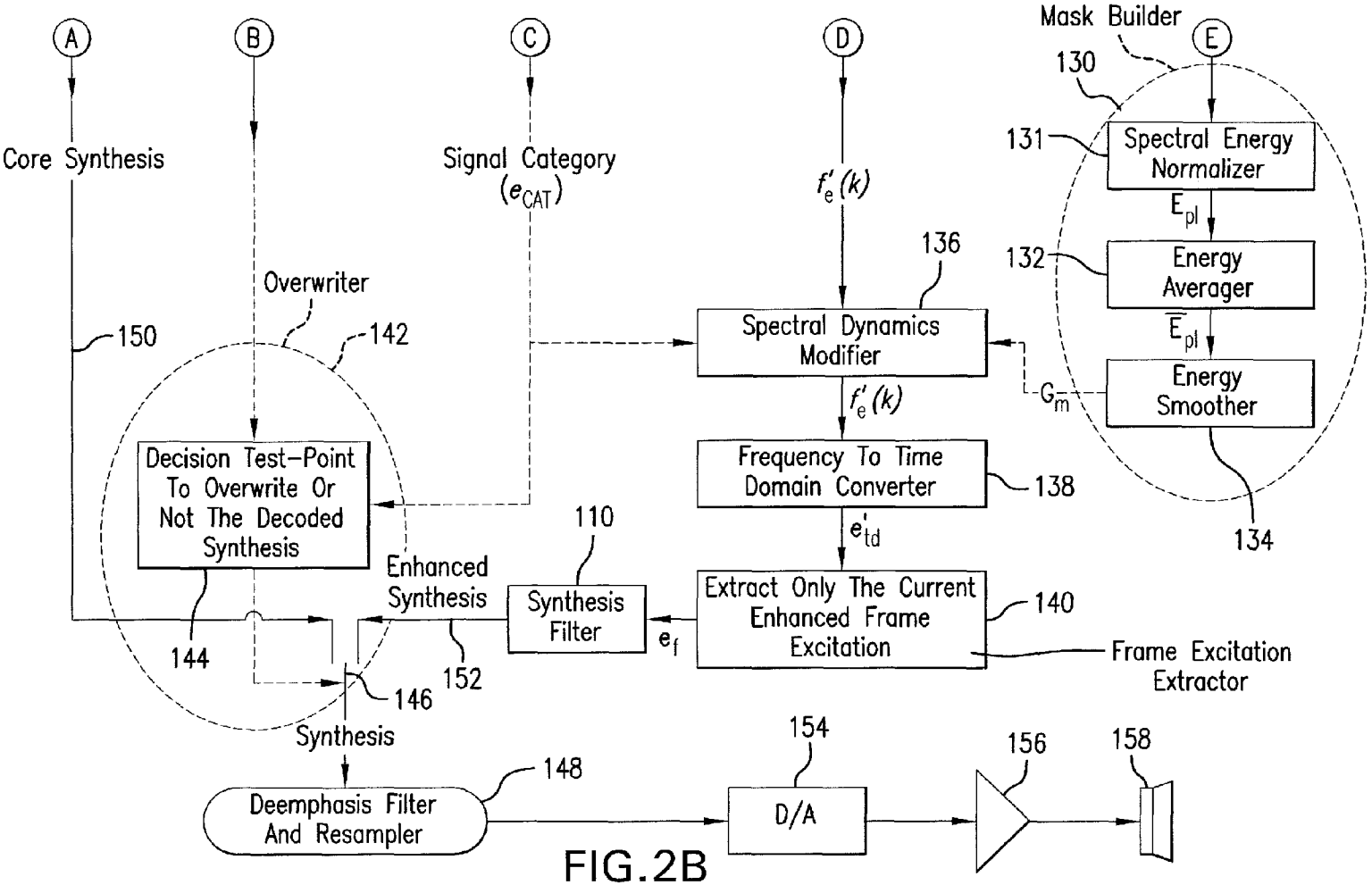

FIGS. 2*a* and 2*b*, collectively referred to as FIG. 2, are a simplified schematic diagram of a decoder having frequency domain post processing capabilities for reducing quantization noise in music signals and other sound signals. A decoder 100 comprises several elements illustrated on FIGS. 2*a* and 2*b*, these elements being interconnected by arrows as shown, some of the interconnections being illustrated using connectors A, B, C, D and E that show how some elements of FIG. 2*a* are related to other elements of FIG. 2*b*. The decoder 100 comprises a receiver 102 that receives an AMR-WB bitstream from an encoder, for example via a radio communication interface. Alternatively, the decoder 100 may be operably connected to a memory (not shown) storing the bitstream. A demultiplexer 103 extracts from the bitstream time domain excitation parameters to reconstruct a time domain excitation, a pitch lag information and a voice activity detection (VAD) information. The decoder 100 comprises a time domain excitation decoder 104 receiving the time domain excitation parameters to decode the time domain excitation of the present frame, a past excitation buffer memory 106, two (2) LP synthesis filters 108 and 110, a first stage signal classifier 112 comprising a signal classification estimator 114 that receives the VAD signal and a class selection test point 116, an excitation extrapolator 118 that receives the pitch lag information, an excitation concatenator 120, a windowing and frequency transform module 122, an energy stability analyzer as a second stage signal classifier 124, a per band noise level estimator 126, a noise reducer 128, a mask builder 130 comprising a spectral energy normalizer 131, an energy averager 132 and an energy smoother 134, a spectral dynamics modifier 136, a frequency to time domain converter 138, a frame excitation extractor 140, an overwriter 142 comprising a decision test point 144 controlling a switch 146, and a de-emphasizing filter and resampler 148. An overwrite decision made by the decision test point 144 determines, based on an INACTIVE or UNVOICED classification obtained from the first stage signal classifier 112 and on a sound signal category $e_{CAT}$ obtained from the second stage signal classifier 124, whether a core synthesis signal 150 from the LP synthesis filter 108, or a modified, i.e. enhanced synthesis signal 152 from the LP synthesis filter 110, is fed to the de-emphasizing filter and resampler 148. An output of the de-emphasizing filter and resampler 148 is fed to a digital to analog (D/A) convertor 154 that provides an analog signal, amplified by an amplifier 156 and provided further to a loudspeaker 158 that generates an audible sound signal. Alternatively, the output of the de-emphasizing filter and resampler 148 may be transmitted in digital format over a communication interface (not shown) or stored in digital format in a memory (not shown), on a compact disc, or on any other digital storage medium. As another alternative, the output of the D/A convertor 154 may be provided to an earpiece (not shown), either directly or through an amplifier. As yet another alternative, the output of the D/A convertor 154 may be recorded on an analog medium (not shown) or transmitted via a communication interface (not shown) as an analog signal.

The following paragraphs provide details of operations performed by the various components of the decoder 100 of FIG. 2.

1) First Stage Classification

In the illustrative embodiment, a first stage classification is performed at the decoder in the first stage classifier 112, in response to parameters of the VAD signal from the demultiplexer 103. The decoder first stage classification is similar as in Vaillancourt '011. The following parameters are used for the classification at the signal classification estimator 114 of the decoder: a normalized correlation $r_x$, a spectral tilt measure $e_t$, a pitch stability counter pc, a relative frame energy of the signal at the end of the current frame $E_s$, and a zero-crossing counter zc. The computation of these parameters, which are used to classify the signal, is explained below.

The normalized correlation $r_x$ is computed at the end of the frame based on the synthesis signal. The pitch lag of the last subframe is used.

The normalized correlation $r_x$ is computed pitch synchronously as $$r_x = \frac{\sum_{i=0}^{T-1} x(t+i)x(t+i-T)}{\sqrt{\sum_{i=0}^{T-1} x^2(t+i) \sum_{i=0}^{T-1} x^2(t+i-T)}} \quad (1)$$

where T is the pitch lag of the last subframe, t=L−T, and L is the frame size. If the pitch lag of the last subframe is larger than 3N/2 (N is the subframe size), T is set to the average pitch lag of the last two subframes.

The correlation $r_x$ is computed using the synthesis signal x(i). For pitch lags lower than the subframe size (64 samples) the normalized correlation is computed twice at instants t=L−T and t=L−2T, and $r_x$ is given as the average of the two computations.

The spectral tilt parameter $e_t$ contains the information about the frequency distribution of energy. In the present illustrative embodiment, the spectral tilt at the decoder is estimated as the first normalized autocorrelation coefficient of the synthesis signal. It is computed based on the last 3 subframes as $$e_t = \frac{\sum_{i=N}^{L-1} x(i)x(i-1)}{\sum_{i=N}^{L-1} x^2(i)} \quad (2)$$

where x(i) is the synthesis signal, N is the subframe size, and L is the frame size (N=64 and L=256 in this illustrative embodiment).

The pitch stability counter pc assesses the variation of the pitch period. It is computed at the decoder as follows:

$$pc=|p_3+p_2-p_1-p_0| \quad (3)$$

The values $p_0$, $p_1$, $p_2$ and $p_3$ correspond to the closed-loop pitch lag from the 4 subframes.

The relative frame energy $E_s$ is computed as a difference between the current frame energy in dB and its long-term average $$E_s=E_f-E_{it} \quad (4)$$

where the frame energy $E_f$ is the energy of the synthesis signal $s_{out}$ in dB computed pitch synchronously at the end of the frame as $$E_f = 10\log_{10}\left(\frac{1}{T}\sum_{i=0}^{T-1} s_{out}^2(i+L-T)\right) \quad (5)$$

where L=256 is the frame length and T is the average pitch lag of the last two subframes. If T is less than the subframe size then T is set to 2T (the energy computed using two pitch periods for short pitch lags).

The long-term averaged energy is updated on active frames using the following relation:

$$E_{it}=0.99E_{it}+0.01E_f \quad (6)$$

The last parameter is the zero-crossing parameter zc computed on one frame of the synthesis signal. In this illustrative embodiment, the zero-crossing counter zc counts the number of times the signal sign changes from positive to negative during that interval.

To make the first stage classification more robust, the classification parameters are considered together forming a function of merit $f_m$. For that purpose, the classification parameters are first scaled using a linear function. Let us consider a parameter $p_x$, its scaled version is obtained using $$p^s=k_p \cdot p_x+c_p \quad (7)$$

The scaled pitch stability parameter is clipped between 0 and 1. The function coefficients $k_p$ and $c_p$ have been found experimentally for each of the parameters. The values used in this illustrative embodiment are summarized in Table 1.

TABLE 1

Signal First Stage Classification Parameters at the decoder and the coefficients of their respective scaling functions

| Parameter | Meaning | $k_p$ | $c_p$ |
|---|---|---|---|
| $r_x$ | Normalized Correlation | 0.8547 | 0.2479 |
| $e_t$ | Spectral Tilt | 0.8333 | 0.2917 |
| pc | Pitch Stability counter | −0.0357 | 1.6074 |
| $E_s$ | Relative Frame Energy | 0.04 | 0.56 |
| zc | Zero Crossing Counter | −0.04 | 2.52 |

The merit function has been defined as $$f_m=1/6(2\cdot r_x^s+e_t^s+pc^s+E_s^s+zc^s) \quad (8)$$

where the superscript s indicates the scaled version of the parameters.

The classification is then done (class selection test point 116) using the merit function $f_m$ and following the rules summarized in Table 2.

TABLE 2

Signal Classification Rules at the decoder

| Previous Frame Class | Rule | Current Frame Class |
|---|---|---|
| OTHER | $f_m \geq 0.39$ | OTHER |
| | $f_m < 0.39$ | UNVOICED |
| UNVOICED | $f_m > 0.45$ | OTHER |
| | $f_m \leq 0.45$ | UNVOICED |
| | VAD = 0 | INACTIVE |

In addition to this first stage classification, information on the voice activity detection (VAD) by the encoder can be transmitted in the bitstream as it is the case with the AMR-WB-based illustrative example. Thus, one bit is sent in the bitstream to specify whether or not the encoder consider the current frame as active content (VAD=1) or INACTIVE content (background noise, VAD=0). When the content is considered as INACTIVE, then the classification is overwritten to UNVOICED. The first stage classification scheme also includes a GENERIC AUDIO detection. The GENERIC AUDIO category includes music, reverberant speech and can also include background music. Two parameters are used to identify this category. One of the parameters is the total frame energy $E_f$ as formulated in Equation (5).

First, the module determines the energy difference $\Delta_E^t$ of two adjacent frames, specifically the difference between the energy of the current frame $E_f^t$ and the energy of the previous frame $E_f^{(t-1)}$. Then the average energy difference $\overline{E}_{df}$ over past 40 frames is calculated using the following relation:

$$\overline{E}_{df} = \frac{\sum_{t=-40}^{t=-1} \Delta_E^t}{40}; \tag{9}$$

where $$\Delta_E^t = E_f^t - E_f^{(t-1)}$$

Then, the module determines a statistical deviation of the energy variation $\sigma_E$ over the last fifteen (15) frames using the following relation:

$$\sigma_E = p\sqrt{\sum_{t=-15}^{t=-1} \frac{(\Delta_E^t - \overline{E_{df}})^2}{15}} \tag{10}$$

In a practical realization of the illustrative embodiment, the scaling factor p was found experimentally and set to about 0.77. The resulting deviation $\sigma_E$ gives an indication on the energy stability of the decoded synthesis. Typically, music has a higher energy stability than speech.

The result of the first-stage classification is further used to count the number of frames $N_{uv}$ between two frames classified as UNVOICED. In the practical realization, only frames with the energy $E_f$ higher than −12 dB are counted. Generally, the counter $N_{uv}$ is initialized to 0 when a frame is classified as UNVOICED. However, when a frame is classified as UNVOICED and its energy $E_f$ is greater than −9 dB and the long term average energy $E_{it}$, is below 40 dB, then the counter is initialized to 16 in order to give a slight bias toward music decision. Otherwise, if the frame is classified as UNVOICED but the long term average energy $E_{it}$ is above 40 dB, the counter is decreased by 8 in order to converge toward speech decision. In the practical realization, the counter is limited between 0 and 300 for active signal; the counter is also limited between 0 and 125 for INACTIVE signal in order to get a fast convergence to speech decision when the next active signal is effectively speech. These ranges are not limiting and other ranges may also be contemplated in a particular realization. For this illustrative example, the decision between active and INACTIVE signal is deduced from the voice activity decision (VAD) included in the bitstream.

A long term average $\overline{N}_{uv}$ is derived from this UNVOICED frames counter for active signal as follows: $N_{UV_t}=0.9\cdot N_{UV_t}+0.1\cdot N_{UV}$ $$\overline{N}_{uv}^{t}=0.9\cdot\overline{N}_{uv}^{(t-1)}+0.1\cdot N_{uv}, \tag{11}$$

and for INACTIVE signal as follows:

$$\overline{N}_{uv}^{t}=0.95\cdot\overline{N}_{uv}^{(t-1)}. \tag{12}$$

where t is the frame index. The following pseudo code illustrates the functionality of the UNVOICED counter and its long term average:

```
if (UNVOICED & E_f > 9dB)
   if (E_lt ≤40)
      N_uv = 16
   else
      N_uv = N_uv − 8
else if(E_f > 12)
   N_uv = N_uv + 1
N_uv = max(min(300,N_uv),0)
if (VAD=0)
   N̄_uv = 0.95·N̄_uv
```

-continued

```
N_uv = min(125,N_uv)
else
   N̄_uv = 0.9·N̄_uv + 0.1·N_uv
```

Furthermore, when the long term average $\overline{N}_{uv}$ is very high and the deviation $\sigma_E$ is also high in a certain frame ($\overline{N}_{uv}$>140 and $\sigma_E$>5 in the current example), meaning that the current signal is unlikely to be music, the long term average is updated differently in that frame. It is updated so that it converges to the value of 100 and biases the decision towards speech. This is done as shown below:

$$\overline{N}_{uv}^{t}=0.2\cdot\overline{N}_{uv}^{(t-1)}+80 \tag{13}$$

This parameter on long term average of the number of frames between UNVOICED classified frames is used to determine if the frame should be considered as GENERIC AUDIO or not. More the UNVOICED frames are close in time, more likely the signal has speech characteristic (less probably it is a GENERIC AUDIO signal). In the illustrative example, the threshold to decide if a frame is considered as GENERIC AUDIO $G_A$ is defined as follows:

$$\text{A frame is } G_A \text{ if: } \overline{N}_{uv}>100 \text{ and } \Delta_E^t<12 \tag{14}$$

The parameter $\Delta_E^t$, defined in equation (9), is used in (14) to avoid classifying large energy variation as GENERIC AUDIO.

The post processing performed on the excitation depends on the classification of the signal. For some types of signals the post processing module is not entered at all. The next table summarizes the cases where the post processing is performed.

TABLE 3

Signal categories for excitation modification

| Frame Classification | Enter post processing module Y/N |
|---|---|
| VOICED | Y |
| GENERIC AUDIO | Y |
| UNVOICED | N |
| INACTIVE | N |

When the post processing module is entered, another energy stability analysis, described hereinbelow, is performed on the concatenated excitation spectral energy. Similarly as in Vaillancourt '050, this second energy stability analysis gives an indication as where in the spectrum the post processing should start and to what extent it should be applied.

2) Creating the Excitation Vector

To increase the frequency resolution, a frequency transform longer than the frame length is used. To do so, in the illustrative embodiment, a concatenated excitation vector $e_c(n)$ is created in excitation concatenator 120 by concatenating the last 192 samples of the previous frame excitation stored in past excitation buffer memory 106, the decoded excitation of the current frame e(n) from time domain excitation decoder 104, and an extrapolation of 192 excitation samples of the future frame $e_x(n)$ from excitation extrapolator 118. This is described below where $L_w$ is the length of the past excitation as well as the length of the extrapolated excitation, and L is the frame length. This corresponds to 192 and 256 samples respectively, giving the total length $L_c$=640 samples in the illustrative embodiment:

$$e_c(n) = \begin{cases} e(n) & n = -L_w, \ldots -1 \\ e(n) & n = 0, \ldots, L-1 \\ e_x(n) & n = L, \ldots, L+L_w-1 \end{cases} \quad (15)$$

In a CELP decoder, the time-domain excitation signal e(n) is given by $$e(n)=bv(n)+gc(n)$$

where v(n) is the adaptive codebook contribution, b is the adaptive codebook gain, c(n) is the fixed codebook contribution, and g is the fixed codebook gain. The extrapolation of the future excitation samples $e_x(n)$ is computed in the excitation extrapolator 118 by periodically extending the current frame excitation signal e(n) from the time domain excitation decoder 104 using the decoded factional pitch of the last subframe of the current frame. Given the fractional resolution of the pitch lag, an upsampling of the current frame excitation is performed using a 35 samples long Hamming windowed sinc function.

3) Windowing

In the windowing and frequency transform module 122, prior to the time-to-frequency transform a windowing is performed on the concatenated excitation. The selected window w(n) has a flat top corresponding to the current frame, and it decreases with the Hanning function to 0 at each end. The following equation represents the window used:

$$w(n) = \begin{cases} 0.5\left(1 - \cos\left(\frac{2\pi(n+L_w)}{2L_w-1}\right)\right) & n = -L_w, \ldots -1 \\ 1.0 & n = 0, \ldots, L-1 \\ 0.5\left(1 - \cos\left(\frac{2\pi((n-L)+L_w)}{2L_w-1}\right)\right) & n = L, \ldots, L+L_w-1 \end{cases} \quad (16)$$

When applied to the concatenated excitation, an input to the frequency transform having a total length $L_c$=640 samples ($L_c$=2$L_w$+L) is obtained in the practical realization. The windowed concatenated excitation $e_{wc}(n)$ is centered on the current frame and is represented with the following equation:

$$e_{wc}(n) = \begin{cases} e(n)w(n) & n = -L_w, \ldots -1 \\ e(n)w(n) & n = 0, \ldots, L-1 \\ e_x(n)w(n) & n = L, \ldots, L+L_w-1 \end{cases} \quad (17)$$

4) Frequency Transform

During the frequency-domain post processing phase, the concatenated excitation is represented in a transform-domain. In this illustrative embodiment, the time-to-frequency conversion is achieved in the windowing and frequency transform module 122 using a type II DCT giving a resolution of 10 Hz but any other transform can be used. In case another transform (or a different transform length) is used, the frequency resolution (defined above), the number of bands and the number of bins per bands (defined further below) may need to be revised accordingly. The frequency representation of the concatenated and windowed time-domain CELP excitation $f_e$ is given below:

$$f_e(k) = \begin{cases} \sqrt{\frac{1}{L_c}} \cdot \sum_{n=0}^{L_c-1} e_{wc}(n), & k = 0 \\ \sqrt{\frac{2}{L_c}} \cdot \sum_{n=0}^{L_c-1} e_{wc}(n) \cdot \cos\left(\frac{\pi}{L_c}\left(n+\frac{1}{2}\right)k\right), & 1 \le k \le L_c - 1 \end{cases} \quad (18)$$

Where $e_{wc}(n)$, is the concatenated and windowed time-domain excitation and $L_c$ is the length of the frequency transform. In this illustrative embodiment, the frame length L is 256 samples, but the length of the frequency transform $L_c$ is 640 samples for a corresponding inner sampling frequency of 12.8 kHz.

5) Energy Per Band and Per Bin Analysis

After the DCT, the resulting spectrum is divided into critical frequency bands (the practical realization uses 17 critical bands in the frequency range 0-4000 Hz and 20 critical frequency bands in the frequency range 0-6400 Hz). The critical frequency bands being used are as close as possible to what is specified in J. D. Johnston, "Transform coding of audio signal using perceptual noise criteria," *IEEE J. Select. Areas Commun.*, vol. 6, pp. 314-323, February 1988, of which the content is herein incorporated by reference, and their upper limits are defined as follows:

$C_B$={100, 200, 300, 400, 510, 630, 770, 920, 1080, 1270, 1480, 1720, 2000, 2320, 2700, 3150, 3700, 4400, 5300, 6400}Hz.

The 640-point DCT results in a frequency resolution of 10 Hz (6400 Hz/640 pts). The number of frequency bins per critical frequency band is $M_{CB}$={10, 10, 10, 10, 11, 12, 14, 15, 16, 19, 21, 24, 28, 32, 38, 45, 55, 70, 90, 110}.

The average spectral energy per critical frequency band $E_B(i)$ is computed as follows:

$$E_B(i) = \frac{1}{L_c M_{CB}(i)} \sum_{h=0}^{M_B(i)-1} (f_e(h+j_i)^2), \quad i = 0, \ldots, 20, \quad (19)$$

where $f_e(h)$ represents the $h^{th}$ frequency bin of a critical band and $j_i$ is the index of the first bin in the $i^{th}$ critical band given by $j_i$={0, 10, 20, 30, 40, 51, 63, 77, 92, 108, 127, 148, 172, 200, 232, 270, 315, 370, 440, 530}.

The spectral analysis also computes the energy of the spectrum per frequency bin, $E_{BIN}(k)$ using the following relation:

$$E_{BIN}(k) = \frac{1}{L_c} f_e(k)^2, \quad k = 0, \ldots, 639 \quad (20)$$

Finally, the spectral analysis computes a total spectral energy $E_C$ of the concatenated excitation as the sum of the spectral energies of the first 17 critical frequency bands using the following relation:

$$E_C = 10 \log_{10}(\Sigma_{i=0}^{16} E_B(i)) - 3.0103, \quad (21)$$

6) Second Stage Classification of the Excitation Signal

As described in Vaillancourt '050, the method for enhancing decoded generic sound signal includes an additional analysis of the excitation signal designed to further maximize the efficiency of the inter-harmonic noise reduction by identifying which frame is well suited for the inter-tone noise reduction.

The second stage signal classifier 124 not only further separates the decoded concatenated excitation into sound signal categories, but it also gives instructions to the inter-harmonic noise reducer 128 regarding the maximum level of attenuation and the minimum frequency where the reduction can start.

In the presented illustrative example, the second stage signal classifier 124 has been kept as simple as possible and is very similar to the signal type classifier described in Vaillancourt '050. The first operation consists in performing an energy stability analysis similarly as done in equations (9) and (10), but using as input the total spectral energy of the concatenated excitation $E_C$ as formulated in Equation (21):

$$\overline{E}_d = \frac{\left(\sum_{t=-40}^{t=-1} \Delta_{E_C}^t\right)}{40}, \quad \text{where} \quad \Delta_{E_C}^t = E_C^t - E_C^{(t-1)} \tag{22}$$

where $\overline{E}_d$ represents the average difference of the energies of the concatenated excitation vectors of two adjacent frames, $E_C{}^t$ represents the energy of the concatenated excitation of the current frame t, and $E_C{}^{(t-1)}$ represents the energy of the concatenated excitation of the previous frame t−1. The average is computed over the last 40 frames.

Then, a statistical deviation $\sigma_C$ of the energy variation over the last fifteen (15) frames is calculated using the following relation:

$$\sigma_C = p \cdot \sqrt{\sum_{t=-15}^{t=-1} \frac{\left(\Delta_{E_C}^t - \overline{E}_d\right)^2}{15}} \tag{23}$$

where, in the practical realization, the scaling factor p is found experimentally and set to about 0.77. The resulting deviation $\sigma_C$ is compared to four (4) floating thresholds to determine to what extend the noise between harmonics can be reduced. The output of this second stage signal classifier 124 is split into five (5) sound signal categories $e_{CAT}$, named sound signal categories 0 to 4. Each sound signal category has its own inter-tone noise reduction tuning.

The five (5) sound signal categories 0-4 can be determined as indicated in the following Table.

TABLE 4 output characteristic of the excitation classifier

| Category $e_{CAT}$ | Enhanced band (wideband) Hz | Allowed reduction dB |
|---|---|---|
| 0 | NA | 0 |
| 1 | [920, 6400] | 6 |
| 2 | [920, 6400] | 9 |
| 3 | [770, 6400] | 12 |
| 4 | [630, 6400] | 12 |

The sound signal category 0 is a non-tonal, non-stable sound signal category which is not modified by the inter-tone noise reduction technique. This category of the decoded sound signal has the largest statistical deviation of the spectral energy variation and in general comprises speech signal.

Sound signal category 1 (largest statistical deviation of the spectral energy variation after category 0) is detected when the statistical deviation $\sigma_C$ of spectral energy variation is lower than Threshold 1 and the last detected sound signal category is ≥0. Then the maximum reduction of quantization noise of the decoded tonal excitation within the frequency band 920 to $$\frac{F_S}{2}\text{Hz}$$

(6400 Hz in this example, where $F_S$ is the sampling frequency) is limited to a maximum noise reduction $R_{max}$ of 6 dB.

Sound signal category 2 is detected when the statistical deviation $\sigma_C$ of spectral energy variation is lower than Threshold 2 and the last detected sound signal category is ≥1. Then the maximum reduction of quantization noise of the decoded tonal excitation within the frequency band 920 to $$\frac{F_S}{2}\text{Hz}$$

is limited to a maximum of 9 dB.

Sound signal category 3 is detected when the statistical deviation $\sigma_C$ of spectral energy variation is lower than Threshold 3 and the last detected sound signal category is ≥2. Then the maximum reduction of quantization noise of the decoded tonal excitation within the frequency band 770 to $$\frac{F_S}{2}\text{Hz}$$

is limited to a maximum of 12 dB.

Sound signal category 4 is detected when the statistical deviation $\sigma_C$ of spectral energy variation is lower than Threshold 4 and when the last detected signal type category is ≥3. Then the maximum reduction of quantization noise of the decoded tonal excitation within the frequency band 630 to $$\frac{F_S}{2}\text{Hz}$$

is limited to a maximum of 12 dB.

The floating thresholds 1-4 help preventing wrong signal type classification. Typically, decoded tonal sound signal representing music gets much lower statistical deviation of its spectral energy variation than speech. However, even music signal can contain higher statistical deviation segment, and similarly speech signal can contain segments with lower statistical deviation. It is nevertheless unlikely that speech and music contents change regularly from one to another on a frame basis. The floating thresholds add decision hysteresis and act as reinforcement of previous state to substantially prevent any misclassification that could result in a suboptimal performance of the inter-harmonic noise reducer 128.

Counters of consecutive frames of sound signal category 0, and counters of consecutive frames of sound signal category 3 or 4, are used to respectively decrease or increase the thresholds.

For example, if a counter counts a series of more than 30 frames of sound signal category 3 or 4, all the floating thresholds (1 to 4) are increased by a predefined value for the purpose of allowing more frames to be considered as sound signal category 4.

The inverse is also true with sound signal category 0. For example, if a series of more than 30 frames of sound signal category 0 is counted, all the floating thresholds (1 to 4) are decreased for the purpose of allowing more frames to be considered as sound signal category 0. All the floating thresholds 1-4 are limited to absolute maximum and minimum values to ensure that the signal classifier is not locked to a fixed category.

In the case of frame erasure, all the thresholds 1-4 are reset to their minimum values and the output of the second stage classifier is considered as non-tonal (sound signal category 0) for three (3) consecutive frames (including the lost frame).

If information from a Voice Activity Detector (VAD) is available and it is indicating no voice activity (presence of silence), the decision of the second stage classifier is forced to sound signal category 0 ($e_{CAT}=0$).

7) Inter-Harmonic Noise Reduction in the Excitation Domain

Inter-tone or inter-harmonic noise reduction is performed on the frequency representation of the concatenated excitation as a first operation of the enhancement. The reduction of the inter-tone quantization noise is performed in the noise reducer 128 by scaling the spectrum in each critical band with a scaling gain $g_s$ limited between a minimum and a maximum gain $g_{min}$ and $g_{max}$. The scaling gain is derived from an estimated signal-to-noise ratio (SNR) in that critical band. The processing is performed on frequency bin basis and not on critical band basis. Thus, the scaling gain is applied on all frequency bins, and it is derived from the SNR computed using the bin energy divided by an estimation of the noise energy of the critical band including that bin. This feature allows for preserving the energy at frequencies near harmonics or tones, thus substantially preventing distortion, while strongly reducing the noise between the harmonics.

The inter-tone noise reduction is performed in a per bin manner over all 640 bins. After having applied the inter-tone noise reduction on the spectrum, another operation of spectrum enhancement is performed. Then the inverse DCT is used to reconstruct the enhanced concatenated excitation $e_{td}$ signal as described later.

The minimum scaling gain $g_{min}$ is derived from the maximum allowed inter-tone noise reduction in dB, $R_{max}$. As described above, the second stage of classification makes the maximum allowed reduction varying between 6 and 12 dB. Thus minimum scaling gain is given by $$g_{min}=10^{-R_{max}/20} \tag{24}$$

The scaling gain is computed related to the SNR per bin. Then per bin noise reduction is performed as mentioned above. In the current example, per bin processing is applied on the entire spectrum to the maximum frequency of 6400 Hz. In this illustrative embodiment, the noise reduction starts at the $6^{th}$ critical band (i.e. no reduction is performed below 630 Hz). To reduce any negative impact of the technique, the second stage classifier can push the starting critical band up to the $8^{th}$ band (920 Hz). This means that the first critical band on which the noise reduction is performed is between 630 Hz and 920 Hz, and it can vary on a frame basis. In a more conservative implementation, the minimum band where the noise reduction starts can be set higher.

The scaling for a certain frequency bin k is computed as a function of SNR, given by $$g_s(k)=\sqrt{k_s \mathrm{SNR}(k)+c_s}, \text{ bounded by } g_{min}\le g_s\le g_{max} \tag{25}$$

Usually $g_{max}$ is equal to 1 (i.e. no amplification is allowed), then the values of $k_s$ and $c_s$ are determined such as $g_s=g_{max}$ for SNR=1 dB, and $g_s=1$ for SNR=45 dB. That is, for SNRs of 1 dB and lower, the scaling is limited to $g_{min}$ and for SNRs of 45 dB and higher, no noise reduction is performed ($g_s=1$). Thus, given these two end points, the values of $k_s$ and $c_s$ in Equation (25) are given by $$k_s=(1-g_{min}^2)/44 \text{ and } c_s=(45g_{min}^2-1)/44. \tag{26}$$

If $g_{max}$ is set to a value higher than 1, then it allows the process to slightly amplify the tones having the highest energy. This can be used to compensate for the fact that the CELP codec, used in the practical realization, doesn't match perfectly the energy in the frequency domain. This is generally the case for signals different from voiced speech.

The SNR per bin in a certain critical band i is computed as $$NRF_{BIN}(h)=\frac{0.3E_{BIN}^{(1)}(h)+0.7E_{BIN}^{(2)}(h)}{N_B(i)}, \quad h=j_1,\ldots,j_i+M_B(i)-1 \tag{27}$$

where $E_{BIN}^{(1)}(h)$ and $E_{BIN}^{(2)}(h)$ denote the energy per frequency bin for the past and the current frame spectral analysis, respectively, as computed in Equation (20), $N_B(i)$ denotes the noise energy estimate of the critical band i, $j_i$ is the index of the first bin in the $i^{th}$ critical band, and $M_B(i)$ is the number of bins in the critical band i as defined above.

The smoothing factor is adaptive and it is made inversely related to the gain itself. In this illustrative embodiment the smoothing factor is given by $\alpha_{gs}=1-g_s$. That is, the smoothing is stronger for smaller gains $g_s$. This approach substantially prevents distortion in high SNR segments preceded by low SNR frames, as it is the case for voiced onsets. In the illustrative embodiment, the smoothing procedure is able to quickly adapt and to use lower scaling gains on the onset.

In case of per bin processing in a critical band with index i, after determining the scaling gain as in Equation (25), and using SNR as defined in Equations (27), the actual scaling is performed using a smoothed scaling gain $g_{BIN,LP}$ updated in every frequency analysis as follows $$g_{BIN,LP}(k)=\alpha_{gs}g_{BIN,LP}(k)+(1-\alpha_{gs})g_s \tag{28}$$

Temporal smoothing of the gains substantially prevents audible energy oscillations while controlling the smoothing using $\alpha_{gs}$ substantially prevents distortion in high SNR segments preceded by low SNR frames, as it is the case for voiced onsets or attacks.

The scaling in the critical band i is performed as $$f'_e(h+j_i)=g_{BIN,LP}(h+j_i)f_e(h+j_i),\ h=0,\ldots,M_B(i)-1 \tag{29}$$

where $j_i$ is the index of the first bin in the critical band i and $M_B(i)$ is the number of bins in that critical band.

The smoothed scaling gains $g_{BIN,LP}(k)$ are initially set to 1. Each time a non-tonal sound frame is processed $e_{CAT}=0$, the smoothed gain values are reset to 1.0 to reduce any possible reduction in the next frame.

Note that in every spectral analysis, the smoothed scaling gains $g_{BIN,LP}(k)$ are updated for all frequency bins in the entire spectrum. Note that in case of low-energy signal, inter-tone noise reduction is limited to −1.25 dB. This happens when the maximum noise energy in all critical bands, max ($N_B$(i)), i=0, . . . , 20, is less or equal to 10.

8) Inter-Tone Quantization Noise Estimation

In this illustrative embodiment, the inter-tone quantization noise energy per critical frequency band is estimated in per band noise level estimator 126 as being the average energy of that critical frequency band excluding the maximum bin energy of the same band. The following formula summarizes the estimation of the quantization noise energy for a specific band i:

$$N_B(i) = \frac{1}{q(i)}\left(\frac{\left(E_B(i)M_B(i) - \max_h(E_{BIN}(h+j_i))\right)}{(M_B(i)-1)}\right), \quad h = 0, \ldots, M_B(i)-1 \tag{30}$$

where $j_i$ is the index of the first bin in the critical band i, $M_B$(i) is the number of bins in that critical band, $E_B$(i) is the average energy of a band i, $E_{BIN}$(h+$j_i$) is the energy of a particular bin and $N_B$(i) is the resulting estimated noise energy of a particular band i. In the noise estimation equation (30), q(i) represents a noise scaling factor per band that is found experimentally and can be modified depending on the implementation where the post processing is used. In the practical realization, the noise scaling factor is set such that more noise can be removed in low frequencies and less noise in high frequencies as it is shown below:

q={10,10,10,10,10,10,11,11,11,11,11,11,11,11,11,15,15, 15,15,15}.

9) Increasing Spectral Dynamic of the Excitation

The second operation of the frequency post processing provides an ability to retrieve frequency information that is lost within the coding noise. The CELP codecs, especially when used at low bitrates, are not very efficient to properly code frequency content above 3.5-4 kHz. The main idea here is to take advantage of the fact that music spectrum often does not change substantially from frame to frame. Therefore a long term averaging can be done and some of the coding noise can be eliminated. The following operations are performed to define a frequency-dependent gain function. This function is then used to further enhance the excitation before converting it back to the time domain.

a. Per Bin Normalization of the Spectrum Energy

The first operation consists in creating in the mask builder 130 a weighting mask based on the normalized energy of the spectrum of the concatenated excitation. The normalization is done in spectral energy normalizer 131 such that the tones (or harmonics) have a value above 1.0 and the valleys a value under 1.0. To do so, the bin energy spectrum $E_{BIN}$(k) is normalized between 0.925 and 1.925 to get the normalized energy spectrum $E_n$(k) using the following equation:

$$E_n(k) = \frac{E_{BIN}(k)}{\max(E_{BIN})} + 0.925, \quad k = 0, \ldots, 639 \tag{31}$$

where $E_{BIN}$(k) represents the bin energy as calculated in equation (20). Since the normalization is performed in the energy domain, many bins have very low values. In the practical realization, the offset 0.925 has been chosen such that only a small part of the normalized energy bins would have a value below 1.0. Once the normalization is done, the resulting normalized energy spectrum is processed through a power function to obtain a scaled energy spectrum. In this illustrative example, a power of 8 is used to limit the minimum values of the scaled energy spectrum to around 0.5 as shown in the following formula:

$$E_p(k)=E_n(k)^8 \quad k=0, \ldots, 639 \tag{32}$$

where $E_n$(k) is the normalized energy spectrum and $E_p$(k) is the scaled energy spectrum. More aggressive power function can be used to reduce furthermore the quantization noise, e.g. a power of 10 or 16 can be chosen, possibly with an offset closer to one. However, trying to remove too much noise can also result in loss of important information.

Using a power function without limiting its output would rapidly lead to saturation for energy spectrum values higher than 1. A maximum limit of the scaled energy spectrum is thus fixed to 5 in the practical realization, creating a ratio of approximately 10 between the maximum and minimum normalized energy values. This is useful given that a dominant bin may have a slightly different position from one frame to another so that it is preferable for a weighting mask to be relatively stable from one frame to the next frame. The following equation shows how the function is applied:

$$E_{pl}(k)=\min(5,E_p(k)) \quad k=0, \ldots, 639 \tag{33}$$

where $E_{pl}$(k) represents limited scaled energy spectrum and $E_p$(k) is the scaled energy spectrum as defined in equation (32).

b. Smoothing of the Scaled Energy Spectrum Along the Frequency Axis and the Time Axis With the last two operations, the position of the most energetic pulses begins to take shape. Applying power of 8 on the bins of the normalized energy spectrum is a first operation to create an efficient mask for increasing the spectral dynamics. The next two (2) operations further enhance this spectrum mask. First the scaled energy spectrum is smoothed in energy averager 132 along the frequency axis from low frequencies to the high frequencies using an averaging filter. Then, the resulting spectrum is processed in energy smoother 134 along the time domain axis to smooth the bin values from frame to frame.

The smoothing of the scaled energy spectrum along the frequency axis can be described with following function:

$$\overline{E}_{pl}(k) = \begin{cases} \dfrac{E_{pl}(k)+E_{pl}(k+1)}{2}, & k=0 \\ \dfrac{E_{pl}(k-1)+E_{pl}(k)+E_{pl}(k+1)}{3}, & k=1, \ldots, 638 \\ \dfrac{E_{pl}(k-1)+E_{pl}(k)}{2}, & k=639 \end{cases} \tag{34}$$

Finally, the smoothing along the time axis results in a time-averaged amplification/attenuation weighting mask $G_m$ to be applied to the spectrum $f'_e$. The weighting mask, also called gain mask, is described with the following equation:

$$G_m^t(k) = \begin{cases} 0.95 \cdot G_m^{(t-1)}(k) + 0.05\overline{E}_{pl}(k), & k=0, \ldots, 319 \\ 0.85 \cdot G_m^{(t-1)}(k) + 0.15\overline{E}_{pl}(k), & k=320, \ldots, 639 \end{cases} \tag{35}$$

where $\overline{E}_{pl}$ is the scaled energy spectrum smoothed along the frequency axis, t is the frame index, and $G_m$ is the time-averaged weighting mask.

A slower adaptation rate has been chosen for the lower frequencies to substantially prevent gain oscillation. A faster adaptation rate is allowed for higher frequencies since the positions of the tones are more likely to change rapidly in the higher part of the spectrum. With the averaging performed on the frequency axis and the long term smoothing performed along the time axis, the final vector obtained in (35) is used as a weighting mask to be applied directly on the enhanced spectrum of the concatenated excitation $f'_e$ of equation (29).

10) Application of the Weighting Mask to the Enhanced Concatenated Excitation Spectrum The weighting mask defined above is applied differently by the spectral dynamics modifier 136 depending on the output of the second stage excitation classifier (value of $e_{CAT}$ shown in table 4). The weighting mask is not applied if the excitation is classified as category 0 ($e_{CAT}=0$; i.e. high probability of speech content). When the bitrate of the codec is high, the level of quantization noise is in general lower and it varies with frequency. That means that the tones amplification can be limited depending on the pulse positions inside the spectrum and the encoded bitrate. Using another encoding method than CELP, e.g. if the excitation signal comprises a combination of time- and frequency-domain coded components, the usage of the weighting mask might be adjusted for each particular case. For example, the pulse amplification can be limited, but the method can be still used as a quantization noise reduction.

For the first 1 kHz (the first 100 bins in the practical realization, the mask is applied if the excitation is not classified as category 0 ($e_{CAT}\neq 0$). Attenuation is possible but no amplification is however performed in this frequency range (maximum value of the mask is limited to 1.0).

If more than 25 consecutive frames are classified as category 4 ($e_{CAT}=4$; i.e. high probability of music content), but not more than 40 frames, then the weighting mask is applied without amplification for all the remaining bins (bins 100 to 639) (the maximum gain $G_{max0}$ is limited to 1.0, and there is no limitation on the minimum gain).

When more than 40 frames are classified as category 4, for the frequencies between 1 and 2 kHz (bins 100 to 199 in the practical realization) the maximum gain $G_{max1}$ is set to 1.5 for bitrates below 12650 bits per second (bps). Otherwise the maximum gain $G_{max1}$ is set to 1.0. In this frequency band, the minimum gain $G_{min1}$ is fixed to 0.75 only if the bitrate is higher than 15850 bps, otherwise there is no limitation on the minimum gain.

For the band 2 to 4 kHz (bins 200 to 399 in the practical realization), the maximum gain $G_{max2}$ is limited to 2.0 for bitrates below 12650 bps, and it is limited to 1.25 for the bitrates equal to or higher than 12650 bps and lower than 15850 bps. Otherwise, then maximum gain $G_{max2}$ is limited to 1.0. Still in this frequency band, the minimum gain $G_{min2}$ is fixed to 0.5 only if the bitrate is higher than 15850 bps, otherwise there is no limitation on the minimum gain.

For the band 4 to 6.4 kHz (bins 400 to 639 in the practical realization), the maximum gain $G_{max3}$ is limited to 2.0 for bitrates below 15850 bps and to 1.25 otherwise. In this frequency band, the minimum gain $G_{min3}$ is fixed to 0.5 only if the bitrate is higher than 15850 bps, otherwise there is no limitation on the minimum gain. It should be noted that other tunings of the maximum and the minimum gain might be appropriate depending on the characteristics of the codec.

The next pseudo-code shows how the final spectrum of the concatenated excitation $f''_e$ is affected when the weighting mask $G_m$ is applied to the enhanced spectrum $f'_e$. Note that the first operation of the spectrum enhancement (as described in section 7) is not absolutely needed to do this second enhancement operation of per bin gain modification.

$$
\begin{aligned}
&\text{if}(e_{CAT} \,!= 0) \\
&\text{if}(e_{CAT} == 4 \forall\, t = -1, \ldots\ -40) \\
&f''_e(k) = \\
&\quad \begin{cases} f'_e(k)\min(G_m(k), G_{max0}), & k = 0, \ldots, 99 \\ f'_e(k)\max(\min(G_m(k), G_{max1}), G_{min1}), & k = 100, \ldots, 199 \\ f'_e(k)\max(\min(G_m(k), G_{max2}), G_{min2}), & k = 200, \ldots, 399 \\ f'_e(k)\max(\min(G_m(k), G_{max3}), G_{min3}), & k = 400, \ldots, 639 \end{cases} \\
&\text{else if}(e_{CAT} == 4 \forall\, t = -1, \ldots\ -25) \\
&f''_e(k) = f'_e(k)\min(Gm(k), 1.0), \qquad k = 0, \ldots, 639 \\
&\text{else} \\
&f''_e(k) = f'_e(k), \qquad k = 0, \ldots, 639
\end{aligned}
\tag{36}
$$

Here $f'_e$, represents the spectrum of the concatenated excitation previously enhanced with the SNR related function $g_{BIN,LP}(k)$ of equation (28), $G_m$ is the weighting mask computed in equation (35), $G_{max}$ and $G_{min}$ are the maximum and minimum gains per frequency range as defined above, t is the frame index with t=0 corresponding to the current frame, and finally $f''_e$ is the final enhanced spectrum of the concatenated excitation.

11) Inverse Frequency Transform

After the frequency domain enhancement is completed, an inverse frequency-to-time transform is performed in frequency to time domain converter 138 in order to get the enhanced time domain excitation back. In this illustrative embodiment, the frequency-to-time conversion is achieved with the same type II DCT as used for the time-to-frequency conversion. The modified time-domain excitation $e'_{td}$ is obtained as $$
e'_{td}(n) = \begin{cases} \sqrt{\dfrac{1}{L_c}} \cdot \sum_{k=0}^{L_c-1} f''_e(k), & n = 0 \\ \sqrt{\dfrac{2}{L_c}} \cdot \sum_{k=0}^{L_c-1} f''_e(k) \cdot \cos\left(\dfrac{\pi}{L_c}\left(k + \dfrac{1}{2}\right)N\right), & 1 \le n \le L_c - 1 \end{cases}
\tag{37}
$$

where $f''_e$ is the frequency representation of the modified excitation, $e'_{td}$ is the enhanced concatenated excitation, and $L_c$ is the length of the concatenated excitation vector.

12) Synthesis Filtering and Overwriting the Current CELP Synthesis

Since it is not desirable to add delay to the synthesis, it has been decided to avoid overlap-and-add algorithm in the construction of the practical realization. The practical realization takes the exact length of the final excitation $e_f$ used to generate the synthesis directly from the enhanced concatenated excitation, without overlap as shown in the equation below:

$$
e_f(n) = e'_{td}(n + L_w),\ n = 0, \ldots, 255 \tag{38}
$$

Here $L_w$ represents the windowing length applied on the past excitation prior the frequency transform as explained in equation (15). Once the excitation modification is done and the proper length of the enhanced, modified time-domain excitation from the frequency to time domain converter 138 is extracted from the concatenated vector using the frame excitation extractor 140, the modified time domain excitation is processed through the synthesis filter 110 to obtain the enhanced synthesis signal for the current frame. This enhanced synthesis is used to overwrite the originally decoded synthesis from synthesis filter 108 in order to increase the perceptual quality. The decision to overwrite is taken by the overwriter 142 including a decision test point 144 controlling the switch 146 as described above in response to the information from the class selection test point 116 and from the second stage signal classifier 124.

Figure 3:
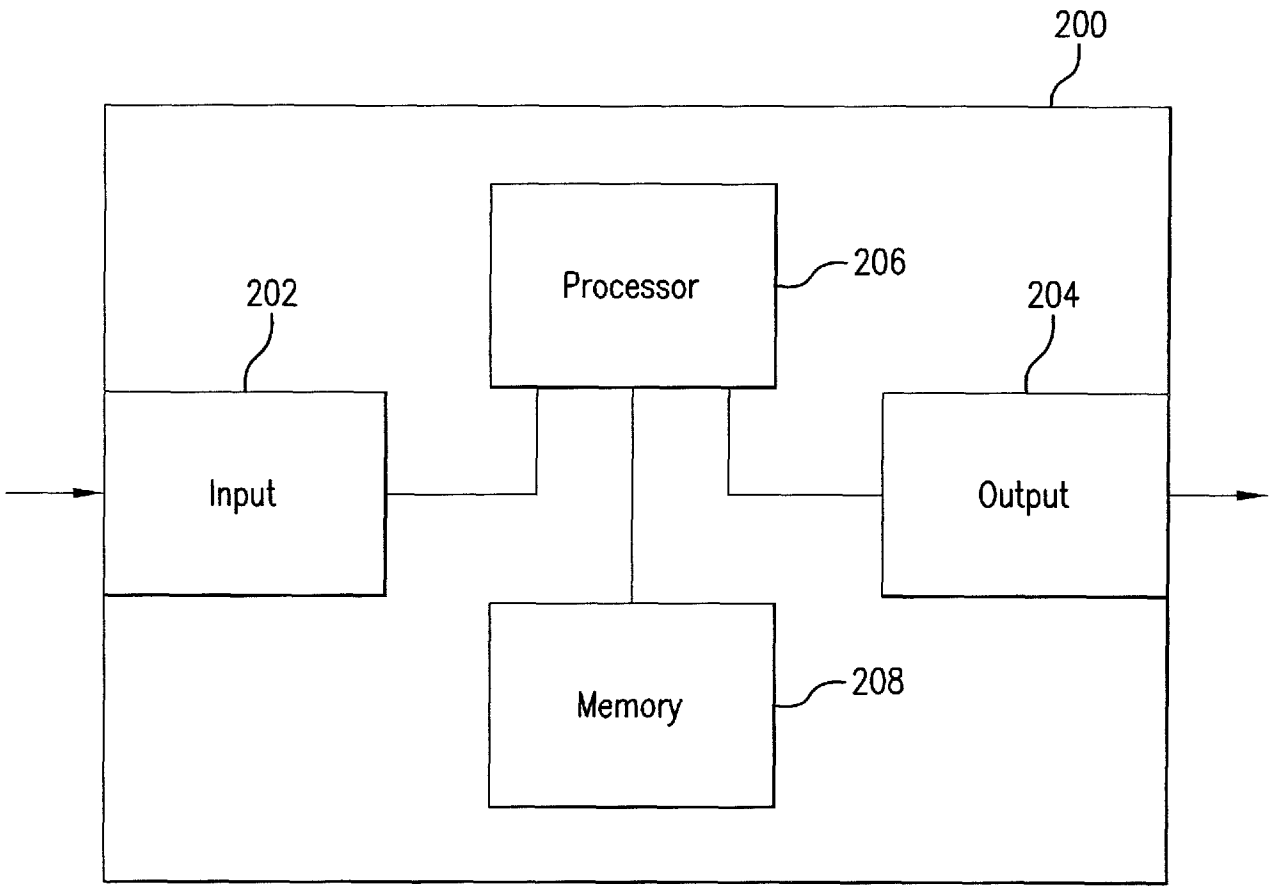
FIG. 3 is a simplified block diagram of an example configuration of hardware components forming the decoder of FIG. 2.

FIG. 3 is a simplified block diagram of an example configuration of hardware components forming the decoder of FIG. 2. A decoder 200 may be implemented as a part of a mobile terminal, as a part of a portable media player, or in any similar device. The decoder 200 comprises an input 202, an output 204, a processor 206 and a memory 208.

The input 202 is configured to receive the AMR-WB bitstream 102. The input 202 is a generalization of the receiver 102 of FIG. 2. Non-limiting implementation examples of the input 202 comprise a radio interface of a mobile terminal, a physical interface such as for example a universal serial bus (USB) port of a portable media player, and the like. The output 204 is a generalization of the D/A converter 154, amplifier 156 and loudspeaker 158 of FIG. 2 and may comprise an audio player, a loudspeaker, a recording device, and the like. Alternatively, the output 204 may comprise an interface connectable to an audio player, to a loudspeaker, to a recording device, and the like. The input 202 and the output 204 may be implemented in a common module, for example a serial input/output device.

The processor 206 is operatively connected to the input 202, to the output 204, and to the memory 208. The processor 206 is realized as one or more processors for executing code instructions in support of the functions of the time domain excitation decoder 104, of the LP synthesis filters 108 and 110, of the first stage signal classifier 112 and its components, of the excitation extrapolator 118, of the excitation concatenator 120, of the windowing and frequency transform module 122, of the second stage signal classifier 124, of the per band noise level estimator 126, of the noise reducer 128, of the mask builder 130 and its components, of the spectral dynamics modifier 136, of the spectral to time domain converter 138, of the frame excitation extractor 140, of the overwriter 142 and its components, and of the de-emphasizing filter and resampler 148.

The memory 208 stores results of various post processing operations. More particularly, the memory 208 comprises the past excitation buffer memory 106. In some variants, intermediate processing results from the various functions of the processor 206 may be stored in the memory 208. The memory 208 may further comprise a non-transient memory for storing code instructions executable by the processor 206. The memory 208 may also store an audio signal from the de-emphasizing filter and resampler 148, providing the stored audio signal to the output 204 upon request from the processor 206.

Those of ordinary skill in the art will realize that the description of the device and method for reducing quantization noise in a music signal or other signal contained in a time-domain excitation decoded by a time-domain decoder are illustrative only and are not intended to be in any way limiting. Other embodiments will readily suggest themselves to such persons with ordinary skill in the art having the benefit of the present disclosure. Furthermore, the disclosed device and method may be customized to offer valuable solutions to existing needs and problems of improving music content rendering of linear-prediction (LP) based codecs.

In the interest of clarity, not all of the routine features of the implementations of the device and method are shown and described. It will, of course, be appreciated that in the development of any such actual implementation of the device and method for reducing quantization noise in a music signal contained in a time-domain excitation decoded by a time-domain decoder, numerous implementation-specific decisions may need to be made in order to achieve the developer's specific goals, such as compliance with application-, system-, network- and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of sound processing having the benefit of the present disclosure.

In accordance with the present disclosure, the components, process operations, and/or data structures described herein may be implemented using various types of operating systems, computing platforms, network devices, computer programs, and/or general purpose machines. In addition, those of ordinary skill in the art will recognize that devices of a less general purpose nature, such as hardwired devices, field programmable gate arrays (FPGAs), application specific integrated circuits (ASICs), or the like, may also be used. Where a method comprising a series of process operations is implemented by a computer or a machine and those process operations may be stored as a series of instructions readable by the machine, they may be stored on a tangible medium.

Although the present disclosure has been described hereinabove by way of non-restrictive, illustrative embodiments thereof, these embodiments may be modified at will within the scope of the appended claims without departing from the spirit and nature of the present disclosure.

What is claimed is:

1. A device implemented in a CELP decoder for reducing quantization noise in a sound signal contained in a decoded CELP time-domain excitation to be processed through a LP synthesis filter to produce a synthesis thereof, the device comprising:

at least one processor; and a memory coupled to the processor and comprising non-transitory code instructions that when executed cause the processor to implement:

a converter of the decoded CELP time-domain excitation, before synthesis, into a frequency-domain excitation;

a mask builder responsive to the frequency-domain excitation to produce a weighting mask for retrieving spectral information lost in the quantization noise;

a modifier of the frequency-domain excitation to increase spectral dynamics by application of the weighting mask to the frequency-domain excitation; and a converter of the modified frequency-domain excitation into a modified CELP time-domain excitation containing a quantization noise-reduced version of the sound signal.

2. A device according to claim 1, comprising:

the LP synthesis filter to produce the synthesis of the decoded CELP time-domain excitation; and a classifier of the synthesis of the decoded CELP time-domain excitation into one of a first set of excitation categories and a second set of excitation categories;

wherein the second set of excitation categories comprises INACTIVE or UNVOICED categories and the first set of excitation categories comprises an OTHER category.

3. A device according to claim 2, wherein the converter of the decoded CELP time-domain excitation into a frequency-domain excitation applies to the decoded CELP time-domain excitation when the synthesis of the decoded CELP time-domain excitation is classified in the first set of excitation categories.

4. A device according to claim 2, wherein the classifier of the synthesis of the decoded CELP time-domain excitation into one of a first set of excitation categories and a second set of excitation categories uses classification information transmitted from an encoder to the CELP decoder and retrieved at the CELP decoder from a decoded bitstream.

5. A device according to claim 2, comprising a second LP synthesis filter to produce a synthesis of the modified CELP time-domain excitation.

6. A device according to claim 5, comprising a de-emphasizing filter and resampler to generate the sound signal from one of the synthesis of the decoded CELP time-domain excitation and of the synthesis of the modified CELP time-domain excitation.

7. A device according to claim 5, comprising a two-stage classifier for selecting an output synthesis as:

the synthesis of the decoded CELP time-domain excitation when the synthesis of the decoded CELP time-domain excitation is classified in the second set of excitation categories; and the synthesis of the modified CELP time-domain excitation when the synthesis of the decoded CELP time-domain excitation is classified in the first set of excitation categories.

8. A device according to claim 1, comprising an analyzer of the frequency-domain excitation to determine whether the frequency-domain excitation contains music.

9. A device according to claim 8, wherein the analyzer of the frequency-domain excitation determines that the frequency-domain excitation contains music by comparing a statistical deviation of spectral energy differences of the frequency-domain excitation with a threshold.

10. A device according to claim 1, comprising an excitation extrapolator to evaluate an excitation of future frames, whereby conversion of the modified frequency-domain excitation into a modified CELP time-domain excitation is delay-less.

11. A device according to claim 10, comprising an excitation concatenator of past frame, current frame and extrapolated future frame time-domain excitations supplied to the converter of the decoded CELP time-domain excitation into the frequency-domain excitation.

12. A device according to claim 1, wherein the mask builder produces the weighting mask using time averaging or frequency averaging, or a combination of time and frequency averaging.

13. A device according to claim 1, comprising a noise reductor to estimate a signal to noise ratio in a selected band of the decoded CELP time-domain excitation and to perform a frequency-domain noise reduction based on the signal to noise ratio.

14. A method implemented in a CELP decoder for reducing quantization noise in a sound signal contained in a decoded CELP time-domain excitation to be processed through a LP synthesis filter to produce a synthesis thereof, the method comprising:

converting, using a time-domain to frequency-domain converter, the decoded CELP time-domain excitation, before synthesis, into a frequency-domain excitation;

producing, using a mask builder and in response to the frequency-domain excitation, a weighting mask for retrieving spectral information lost in the quantization noise;

modifying the frequency-domain excitation to increase spectral dynamics by application of the weighting mask to the frequency-domain excitation; and converting, using a frequency-domain to time-domain converter, the modified frequency-domain excitation into a modified CELP time-domain excitation containing a quantization noise-reduced version of the sound signal.

15. A method according to claim 14, comprising:

processing the decoded CELP time-domain excitation through the LP synthesis filter to produces a synthesis of the decoded CELP time-domain excitation; and classifying the synthesis of the decoded CELP time-domain excitation into one of a first set of excitation categories and a second set of excitation categories;

wherein the second set of excitation categories comprises INACTIVE or UNVOICED categories and the first set of excitation categories comprises an OTHER category.

16. A method according to claim 15, comprising applying a conversion of the decoded CELP time-domain excitation into a frequency-domain excitation to the decoded CELP time-domain excitation when the synthesis of the decoded CELP time-domain excitation is classified in the first set of excitation categories.

17. A method according to claim 15, comprising using classification information transmitted from an encoder to the CELP decoder and retrieved at the CELP decoder from a decoded bitstream to classify the synthesis of the decoded CELP time-domain excitation into the one of a first set of excitation categories and a second set of excitation categories.

18. A method according to claim 15, comprising producing a synthesis of the modified CELP time-domain excitation.

19. A method according to claim 18, comprising generating the sound signal from one of the synthesis of the decoded CELP time-domain excitation and of the synthesis of the modified CELP time-domain excitation.

20. A method according to claim 18, comprising selecting an output synthesis as:

the synthesis of the decoded CELP time-domain excitation when the synthesis of the decoded CELP time-domain excitation is classified in the second set of excitation categories; and the synthesis of the modified CELP time-domain excitation when the synthesis of the decoded CELP time-domain excitation is classified in the first set of excitation categories.

21. A method according to claim 14, comprising analyzing the frequency-domain excitation to determine whether the frequency-domain excitation contains music.

22. A method according to claim 21, comprising determining that the frequency-domain excitation contains music by comparing a statistical deviation of spectral energy differences of the frequency-domain excitation with a threshold.

23. A method according to claim 14, comprising evaluating an extrapolated excitation of future frames, whereby conversion of the modified frequency-domain excitation into a modified CELP time-domain excitation is delay-less.

24. A method according to claim 23, comprising concatenating past frame, current frame and extrapolated future frame time-domain excitations for conversion into the frequency-domain excitation.

25. A method according to claim 14, wherein the weighting mask is produced using time averaging or frequency averaging or a combination of time and frequency averaging.

26. A method according to claim 14, comprising:

estimating a signal to noise ratio in a selected band of the decoded CELP time-domain excitation; and performing a frequency-domain noise reduction based on the estimated signal to noise ratio.

27. A device for reducing quantization noise in a sound signal contained in a time-domain excitation decoded by a time-domain decoder, comprising:

at least one processor; and a memory coupled to the processor and comprising non-transitory code instructions that when executed cause the processor to implement:

a converter of the decoded time-domain excitation into a frequency-domain excitation;

a mask builder responsive to the frequency-domain excitation to produce a weighting mask for retrieving spectral information lost in the quantization noise;

a modifier of the frequency-domain excitation to increase spectral dynamics by application of the weighting mask to the frequency-domain excitation; and a converter of the modified frequency-domain excitation into a modified time-domain excitation containing a quantization noise-reduced version of the sound signal;

wherein the mask builder comprises:

a normalizer of a spectral energy of the frequency-domain excitation to produce a scaled energy spectrum;

an averager of the scaled energy spectrum along a frequency axis; and a smoother of the averaged energy spectrum along a time-domain axis to smooth frequency spectrum values from frame to frame.

28. A device according to claim 27, wherein the normalizer produces a normalized energy spectrum, applies a power value to the normalized energy spectrum to produce the scaled energy spectrum, and limits a value of the scaled energy spectrum to a maximum limit.

29. A method for reducing quantization noise in a sound signal contained in a time-domain excitation decoded by a time-domain decoder, comprising:

converting, using a time-domain to frequency-domain converter, the decoded time-domain excitation into a frequency-domain excitation;

producing, using a mask builder and in response to the frequency-domain excitation, a weighting mask for retrieving spectral information lost in the quantization noise;

modifying the frequency-domain excitation to increase spectral dynamics by application of the weighting mask to the frequency-domain excitation; and converting, using a frequency-domain to time-domain converter, the modified frequency-domain excitation into a modified time-domain excitation containing a quantization noise-reduced version of the sound signal;

wherein producing a weighting mask comprises:

normalizing a spectral energy of the frequency-domain excitation to produce a scaled energy spectrum;

averaging the scaled energy spectrum along a frequency axis; and smoothing the averaged energy spectrum along a time-domain axis to smooth frequency spectrum values from frame to frame.

30. A method according to claim 29, wherein normalizing the spectral energy of the frequency-domain excitation comprises producing a normalized energy spectrum, applying a power value to the normalized energy spectrum to produce the scaled energy spectrum, and limiting a value of the scaled energy spectrum to a maximum limit.

* * * * *